US009247855B2

(12) United States Patent
Hansen et al.

(10) Patent No.: US 9,247,855 B2
(45) Date of Patent: Feb. 2, 2016

(54) SURFACE CLEANING APPARATUS

(71) Applicants: BISSELL Homecare, Inc., Grand Rapids, MI (US); The Procter & Gamble Company, Cincinnati, OH (US)

(72) Inventors: Eric J. Hansen, Ada, MI (US); Michael T. Dillane, Grand Rapids, MI (US); Juan C. Flores-Escribano, West Chester, OH (US); Jeffrey A. Scholten, Ada, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 21 days.

(21) Appl. No.: 14/326,794

(22) Filed: Jul. 9, 2014

(65) Prior Publication Data

US 2015/0020329 A1 Jan. 22, 2015

Related U.S. Application Data

(60) Provisional application No. 61/846,777, filed on Jul. 16, 2013.

(51) Int. Cl.

| | |
|---|---|
| ***A47L 11/00*** | (2006.01) |
| ***A47L 11/40*** | (2006.01) |
| ***A47L 13/22*** | (2006.01) |

(52) U.S. Cl.

CPC ..... *A47L 11/4083* (2013.01); *A47L 11/405* (2013.01); *A47L 11/4036* (2013.01); *A47L 11/4086* (2013.01); *A47L 11/4088* (2013.01); *A47L 13/225* (2013.01)

(58) Field of Classification Search

CPC ..... A47L 11/405; A47L 11/4036; A47L 11/4083; A47L 11/4086; A47L 11/4088; A47L 13/225

USPC ..... 15/320, 49.1, 97.1, 98, 118, 403

IPC ..... A47L 11/00

See application file for complete search history.

(56) References Cited

U.S. PATENT DOCUMENTS

| | | | |
|---|---|---|---|
| 3,497,898 | A | 3/1970 | Sawyer |
| 3,507,695 | A | 4/1970 | Sawyer |
| 3,608,108 | A | 9/1971 | Sawyer |
| 3,609,787 | A | 10/1971 | Aurelio et al. |

(Continued)

FOREIGN PATENT DOCUMENTS

| | | | |
|---|---|---|---|
| CN | 201052124 | Y | 4/2008 |
| WO | 03094688 | A1 | 11/2003 |
| WO | 2005011461 | A1 | 2/2005 |

OTHER PUBLICATIONS

Yusuf G. Adewuyi, Sonochemistry in Environmental Remediation. 1 Combinative and Hybrid Sonophotochemical Oxidation Processes for the Treatment of Pollutants in Water, Environmental Science & Technology, vol. 39, No. 10, Apr. 8, 2005, 12 pages, Greensboro North Carolina.

*Primary Examiner* — David Redding

(74) *Attorney, Agent, or Firm* — McGarry Bair PC

(57) ABSTRACT

A surface cleaning apparatus includes a housing with an on-board reactive oxygen species generator which produces reactive oxygen species in situ from fluid stored within an on-board supply tank of the surface cleaning apparatus, and further delivers the generated reactive oxygen species to a cleaning pad attached to the housing of the surface cleaning apparatus.

20 Claims, 6 Drawing Sheets

(56) References Cited

U.S. PATENT DOCUMENTS

| | | | | |
|---|---|---|---|---|
| 4,069,541 | A | 1/1978 | Williams et al. | |
| 4,356,590 | A | 11/1982 | Goldsmith | |
| 5,309,593 | A | 5/1994 | Yonehara | |
| 6,624,133 | B1 | 9/2003 | McKenzie et al. | |
| 6,689,730 | B2 | 2/2004 | Hortel et al. | |
| 7,004,182 | B2 | 2/2006 | Duval et al. | |
| 7,210,185 | B2 | 5/2007 | Paas | |
| 7,774,894 | B2 | 8/2010 | Rippl et al. | |
| 7,811,022 | B2 | 10/2010 | Bobrosky et al. | |
| 8,595,892 | B1 * | 12/2013 | Everette, Jr. | A47L 11/302 15/319 |
| 2002/0179124 | A1 | 12/2002 | Van Hauwermeiren et al. | |
| 2002/0189633 | A1 | 12/2002 | Nichole Powers et al. | |
| 2002/0189634 | A1 | 12/2002 | Vanhauwermeiren et al. | |
| 2002/0189635 | A1 | 12/2002 | Bodet et al. | |
| 2004/0163199 | A1 | 8/2004 | Hsu | |
| 2005/0236012 | A1 | 10/2005 | Josefsson et al. | |
| 2005/0241666 | A1 | 11/2005 | Bodet et al. | |
| 2005/0241667 | A1 | 11/2005 | Bodet et al. | |
| 2007/0107150 | A1 | 5/2007 | Smith | |
| 2014/0259510 | A1 * | 9/2014 | Conrad | A47L 13/225 15/319 |

* cited by examiner

SURFACE CLEANING APPARATUS

CROSS-REFERENCE TO RELATED APPLICATION

This application claims the benefit of U.S. Provisional Patent Application No.

61/846,777, filed Jul. 16, 2013, which is incorporated herein by reference in its entirety.

BACKGROUND OF THE INVENTION

Surface cleaning apparatuses, such as steam mops and hand-held steamers are configured for cleaning a wide variety of common household surfaces such as bare flooring, including tile, hardwood, laminate, vinyl, and linoleum, as well as carpets, rugs, countertops, stove tops and the like. Typically, steam mops have at least one fluid tank or reservoir for storing a fluid, generally water, which is fluidly connected to a steam generator via a flow control mechanism, such as a pump or valve. The steam generator includes a heater for heating the fluid to produce steam, which can be directed towards the surface to be cleaned through a steam outlet, typically located in a foot or cleaning head that engages the surface to be cleaned during use. The steam is typically applied to one side of a cleaning pad that is attached to the cleaning head, with the opposite side used to wipe the surface to be cleaned. The steam saturates the cleaning pad, and the damp cleaning pad is wiped across the surface to be cleaned to remove dirt, debris, and other soils present on the surface.

BRIEF DESCRIPTION OF THE INVENTION

In one aspect, the invention relates to a surface cleaning apparatus including a housing adapted to be moved across a surface to be cleaned, a fluid distribution system provided with the housing, and comprising a fluid supply tank from which a portion of the fluid is provided, a cleaning pad mounted to the housing and in fluid communication with the fluid distribution system, and a reactive oxygen species generator provided with the housing in fluid communication with the supply tank. The reactive oxygen species generator includes a transducer and an acoustic horn operably coupling the transducer to the portion of the fluid, wherein the acoustic horn transfers energy to the portion of the fluid to generate reactive oxygen species which are provided to the cleaning pad.

In another aspect, the invention relates to a method of generating reactive oxygen species on-board a surface cleaning apparatus having a housing with a cleaning pad attached to the housing. The method includes ultrasonically cavitating a fluid containing water molecules to generate reactive oxygen species and providing the generated reactive oxygen species to the cleaning pad.

BRIEF DESCRIPTION OF THE DRAWING(S)

DETAILED DESCRIPTION OF THE INVENTION

Figure 1:
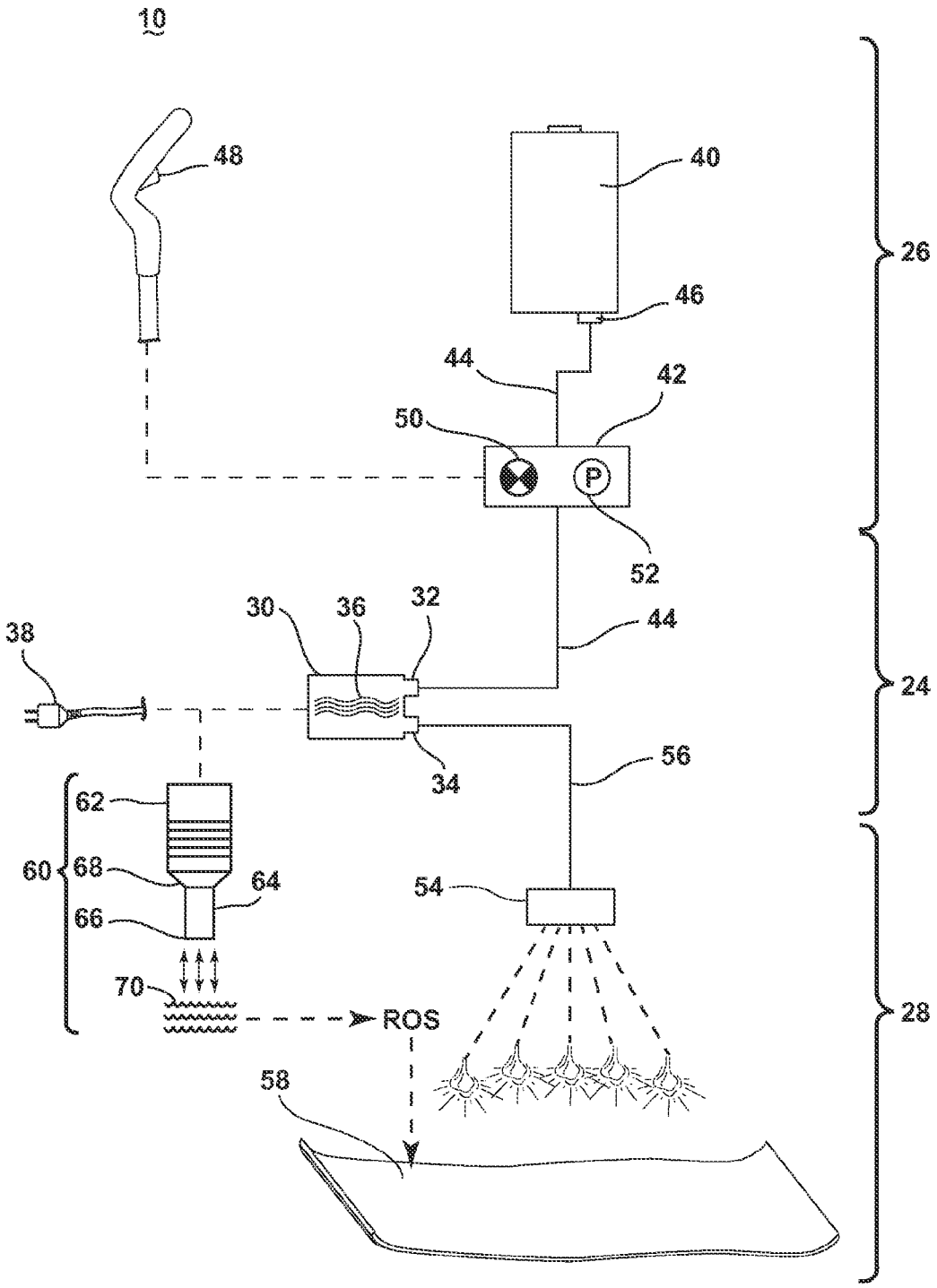
FIG. 1 is a schematic view of a surface cleaning apparatus according to a first embodiment of the invention.

FIG. 1 is a schematic view of various functional systems of a surface cleaning apparatus in the form of a steam mop 10 according to a first embodiment of the invention. While referred to herein as a steam mop 10, the surface cleaning apparatus can alternatively be configured as a hand-held steam applicator device, or as an apparatus having a hand-held accessory tool connected to a canister or other portable device by a steam distribution hose. Additionally, the surface cleaning apparatus can be configured to distribute liquid rather than steam, and/or can additionally have agitation capability, including scrubbing and/or sweeping, vacuuming capability, and/or extraction capability.

The steam mop 10 includes a steam generation system 24 for producing steam from liquid, a fluid distribution system 26 for storing a liquid and delivering the liquid to the steam generation system 24, and a steam delivery system 28 for delivering steam to a surface to be cleaned.

The steam generation system 24 can include a steam generator 30 producing steam from liquid. The steam generator 30 can include an inlet 32 and an outlet 34, and a heater 36 between the inlet 32 and outlet 34 for boiling the liquid. Some non-limiting examples of steam generators 30 include, but are not limited to, a flash heater, a boiler, an immersion heater, and a flow-through steam generator. The steam generator 30 can be electrically coupled to a power source 38, such as a battery or by a power cord plugged into a household electrical outlet.

The fluid distribution system 26 can include at least one supply tank 40 for storing a supply of fluid. The fluid can comprise one or more of any suitable cleaning fluids, including, but not limited to, water, compositions, concentrated detergent, diluted detergent, etc., and mixtures thereof. For example, the fluid can comprise a mixture of water and concentrated detergent. The fluid distribution system 26 can further include multiple supply tanks, such as one tank containing water and another tank containing a cleaning agent.

The fluid distribution system 26 can comprise a flow controller 42 for controlling the flow of fluid through a fluid conduit 44 coupled between an outlet port 46 of the supply tank 40 and the inlet 32 of the steam generator 30. An actuator 48 can be provided to actuate the flow controller 42 and dispense fluid to the steam generator 30.

In one configuration, the fluid distribution system 26 can comprise a gravity-feed system and the flow controller 42 can comprise a valve 50, whereby when valve 50 is open, fluid will flow under the force of gravity, through the fluid conduit 44, to the steam generator 30. The actuator 48 can be operably coupled to the valve 50 such that pressing the actuator 48 will open the valve 50. The valve 50 can be mechanically actuated, such as by providing a push rod with one end coupled to the actuator 48 and another end in register with the valve 50, such that pressing the actuator 48 forces the push rod to open the valve 50. Alternatively, the valve 50 can be electrically actuated, such as by providing electrical switch between the valve 50 and the power source 38 that is selectively closed when the actuator 48 is actuated, thereby powering the valve 50 to move to an open position.

In another configuration, the flow controller 42 can comprise a pump 52 which distributes fluid from the supply tank 40 to the steam generator 30. The actuator 48 can be operably coupled to the pump 52 such that pressing the actuator 48 will activate the pump 52. The pump 52 can be electrically actuated, such as by providing electrical switch between the pump 52 and the power source 38 that is selectively closed when the actuator 48 is actuated, thereby activating the pump 52.

The steam delivery system 28 can include at least one steam outlet 54 for delivering steam to the surface to be cleaned, and a fluid conduit 56 coupled between an outlet 34 of the steam generator 30 and the at least one steam outlet 54. The at least one steam outlet 54 can comprise any structure, such as a perforated manifold or at least one nozzle; multiple steam outlets can also be provided. In use, the generated steam is pushed out of the outlet 34 of the steam generator 30 by pressure generated within the steam generator 30 and, optionally, by pressure generated by the pump 52 or a separate fan (not shown). The steam flows through the fluid conduit 56, and out of the at least one steam outlet 54.

A cleaning pad 58 can be removably attached over the steam outlet 54 to the steam mop 10. In use, the cleaning pad 58 is saturated by the steam from the steam outlet 54, and the damp cleaning pad 58 is wiped across the surface to be cleaned to remove dirt present on the surface. The cleaning pad 58 can be provided with features that enhance the scrubbing action on the surface to be cleaned to help loosen dirt on the surface. The cleaning pad 58 can be disposable or reusable, and can further be provided with a cleaning agent or composition that is delivered to the surface to be cleaned along with the steam. For example, the cleaning pad 58 can comprise disposable sheets that are pre-moistened with a cleaning agent. The cleaning agent can be configured to interact with the steam, such as having at least one component that is activated or deactivated by the temperature and/or moisture of the steam. In one example, the temperature and/or moisture of the steam can act to release the cleaning agent from the cleaning pad 58.

The steam mop 10 further comprises a reactive oxygen species generator 60 which produces reactive oxygen species (ROS) in situ from the sonolysis of water stored on the steam mop 10.The generated reactive oxygen species are then applied to a surface to be cleaned. In particular, the cleaning pad 58 can be used to apply the reactive oxygen species to the surface, which can oxidize organic and/or dye-based stains and odors.

The reactive oxygen species generator 60 can comprise an ultrasound generator which produces ultrasonic energy that is transmitted with ultrasonic waves at a frequency of at least 20 kHz, or beyond the normal hearing range of humans. The ultrasound generator can comprise a transducer 62 coupled with an acoustic horn 64 having an output tip 66. The acoustic horn 64 and output tip 66 can have any suitable geometric form; one non-limiting example of an acoustic horn 64 can comprise a blade. Ultrasonic waves from the transducer 62 are fed via an input end 68 of the horn 64 into the output tip 66. The transducer 62 can be electrically coupled to the power source 38 or its own dedicated power source, and converts the electricity into ultrasound. The reactive oxygen species generator 60 further includes a fluid source 70, which can be stored on the steam mop 10, and can be supplied to the reactive oxygen species generator 60 in the form of liquid or steam.

When the reactive oxygen species generator 60 is activated, the transducer 62 produces ultrasonic energy that is focused by the horn 64, which delivers energy as acoustical waves to water molecules ($H_2O$) of the fluid source 70. The acoustical waves induce cavitation in which millions of small bubbles rapidly form and collapse in the water. The sudden collapse of the bubbles can lead to localized, transient high temperatures and pressures which result in the generation of reactive oxygen species such as hydroxyl radicals (OH•), hydrogen radicals (H•), and hydroperoxyl radicals ($HO_2$•). The radical formation has been attributed to the thermal dissociation of water vapor present in the cavities during the compression phase. The radicals generated during sonolysis can further react to produce additional reactive oxygen species, such as hydrogen peroxide ($H_2O_2$), via hydroxyl radicals, as illustrated in the reaction mechanism below.

$$H_2O + ))) \rightarrow H\bullet + \bullet O$$
$$\bullet OH + \bullet OH \rightarrow H_2O + O\bullet$$
$$\bullet OH + H_2O \rightarrow H_2O_2 + O\bullet$$
$$H\bullet + \bullet OH \rightarrow H_2O$$
$$H\bullet + H\bullet \rightarrow H_2$$
$$O\bullet + O\bullet \rightarrow O_2$$
$$\bullet OH + \bullet OH \rightarrow H_2 + O_2$$
$$\bullet OH(aq) + \bullet OH(aq) \rightarrow H_2O_2(aq)$$
$$H\bullet + O_2 \rightarrow HO_2\bullet$$
$$HO_2\bullet + H\bullet \rightarrow H_2O_2$$
$$HO_2\bullet + HO_2\bullet \rightarrow H_2O_2 + O_2$$
$$O_2 \rightarrow 2O\bullet$$
$$O_2 + O\bullet \rightarrow O_3$$

))) Ultrasound waves.

The resulting reactive oxygen species can remove organic stains or soils via oxidation and can treat stains having an unstable bond structure (for example, double bonded carbons), including both visible stains and odors.

The reactive oxygen species generator 60 can be integrated with one or more of the steam generation system 24, fluid distribution system 26, and steam delivery system 28. For example, the fluid source 70 can comprise the supply tank 40 and the water molecules for the sonolysis reaction can be the steam delivered to the pad 58 via the steam outlet 54. Alternatively, reactive oxygen species generator 60 can be a separate system, with a dedicated fluid source 70 and delivery means to the cleaning pad 58.

The sonolysis reaction is frequency dependent, and a frequency in the range of 20-500 kHz can be supplied in the presence of water molecules in order for the sonolysis reaction to take place. More particularly, a frequency of around 20 kHz can be supplied to the water molecules in order for the sonolysis reaction to take place. Frequencies below 20 kHz are not effective because the cavitation produced at these lower frequencies is too weak for a substantial amount of reactive oxygen species to be produced. Higher frequencies, including those up to 500 kHz can also be used to produce reactive oxygen species; frequencies higher than 500 kHz may not be practical since too much energy is required.

The steam mop 10 shown in FIG. 1 can be used to effectively generate reactive oxygen species to remove stains from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

The cleaning pad 58 is attached to the steam mop 10, over the steam outlet 54, the supply tank 40 is filled with fluid, and the steam generator 30 and transducer 62 are coupled to the power source 38. Upon actuation of the actuator 48, fluid flows to the steam generator 30 and is heated to its boiling point to produce steam. Fluid also flows to the reactive oxygen species generator 60 and is used to generate reactive oxygen species. The steam and reactive oxygen species are passed through the cleaning pad 58. As steam passes through the cleaning pad 58, a portion of the steam may return to liquid form before reaching the floor surface. The steam delivered to the floor surface also returns to liquid form. As the damp cleaning pad 58 is wiped over the surface to be cleaned, excess liquid and dirt on the surface is absorbed by the cleaning pad 58.

Figure 2:
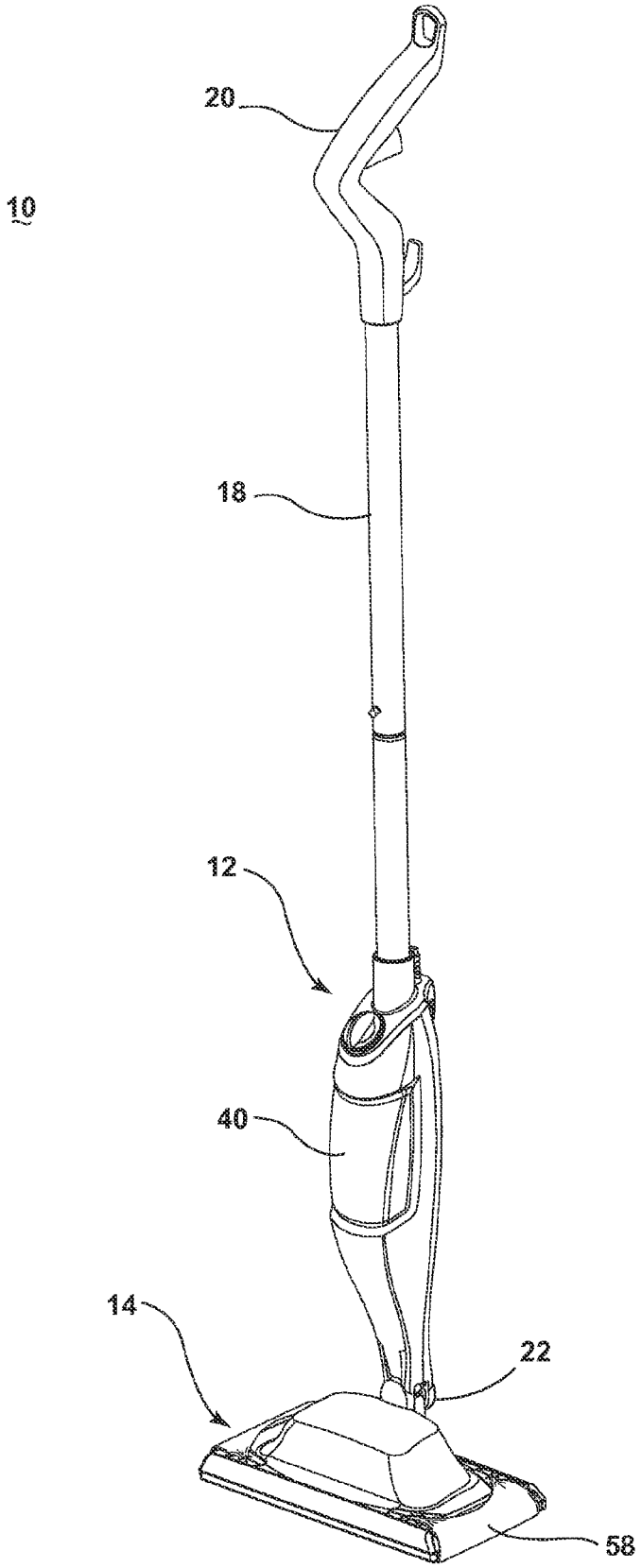
FIG. 2 is a front perspective view of a surface cleaning apparatus in the form of a steam mop according to a second embodiment of the invention.

FIG. 2 is a front perspective view of a surface cleaning apparatus in the form of a steam mop 10 according to a second embodiment of the invention. For purposes of description related to the figures, the terms "upper," "lower," "right," "left," "rear," "front," "vertical," "horizontal," "inner," "outer," and derivatives thereof shall relate to the invention as oriented in FIG. 1 from the perspective of a user behind the steam mop 10, which defines the rear of the steam mop 10. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The steam mop 10 comprises a upper housing 12 mounted to a lower cleaning foot 14 which is adapted to be moved across a surface to be cleaned. The housing 12 and the foot 14 may each support one or more components of the various functional systems discussed with respect to FIG. 1. An elongated handle 18 can project from the housing 12, with a handle grip 20 provided on the end of the handle 18 to facilitate movement of the steam mop 10 by a user. A coupling joint 22 is formed at an opposite end of the housing 12 and moveably mounts the foot 14 to the housing 12. In the embodiment shown herein, the coupling joint 22 can comprise a universal joint, such that the foot 14 can pivot about at least two axes relative to the housing 12.

Figure 3:
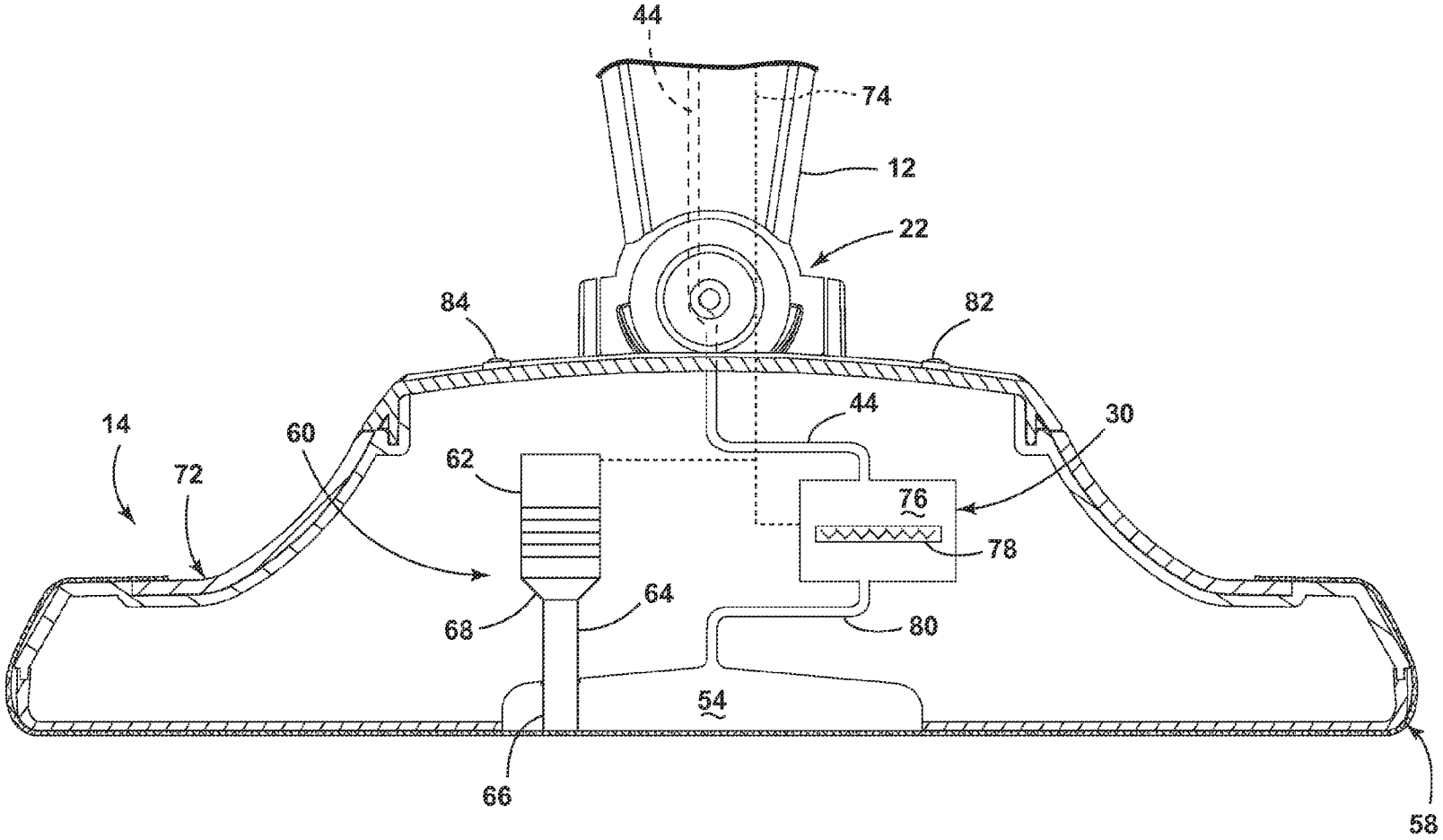
FIG. 3 is a schematic view of a foot for the steam mop of FIG. 2.

FIG. 3 is a schematic view of the foot 14 from FIG. 2. The foot 14 can comprise a housing 72 adapted to be moved over the surface to be cleaned and which carries the steam generator 30 and reactive oxygen species generator 60, and can mount the cleaning pad 58.

The housing 72 defines an interior in which the transducer 62 of the reactive oxygen species generator 60 is located. The horn 64 can project out of the housing 72, with the output tip 66 in contact with an upper surface of the cleaning pad 58 coupled to the bottom of the foot 14. The transducer 62 can be coupled with the power source 38 via an electrical conductor 74 that extends through the coupling joint 22.

The steam generator 30 can comprise a flash heater having a cavity 76 defined within the interior of the housing 72 and an electrical heating element 78 mounted within the cavity 76 which can be coupled with the power source 38 via the electrical conductor 74. The heating element 78 is configured to flash heat fluid and convert the fluid into steam. A thermostat (not shown) can be connected to the heating element 78 and adapted to regulate the operational temperature of the heating element 78 based on a desired performance criteria. For example, the thermostat can regulate the operational temperature to meet the boiling point of the fluid to be converted to steam.

The fluid conduit 44 can extend through the coupling joint 22 and can comprise flexible tubing in order to bend with the movement of the handle 18. In one configuration, the fluid conduit 44 can comprise flexible silicone, polyurethane or polyvinyl chloride tubing, for example. Within the foot 14, the fluid conduit 44 can couple with the cavity 76 to supply fluid to the steam generator 30. The fluid conduit 44 to the steam generator 30 couples with the cavity 76 above the heating element 78, such that fluid falls on the heating element 78. The fluid conduit 44 can include an orifice restrictor (not shown) for limiting the flow rate of fluid into the cavity 76 of the flash heater to achieve a drip-type dispersion of fluid onto the heating element. An outlet conduit 80 of the steam generator 30 extends from the cavity 76 to the steam outlet 54.

The steam mop 10 can be provided with visual indicia 82, 84 to give the user an indication of the functional status of the steam generator 30 and/or reactive oxygen species generator 60. For example, a first light 82 can be configured to illuminate when the steam generator 30 has reached the threshold operational temperature for generating steam and a second light 84 can be configured to illuminate when the reactive oxygen species generator 60 is producing reactive oxygen species. In one configuration, the first light 82 can be electrically coupled with the thermostat (not shown) and is configured to illuminate only after the steam generator 30 reaches a predetermined operating temperature as determined by the thermostat and the second light 84 can be configured to illuminate when the transducer 62 is on.

The steam mop 10 shown in FIGS. 2-3 can be used to effectively generate reactive oxygen species which remove stains from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

In operation, the cleaning pad 58 is attached to the foot 14, the supply tank 40 is filled with fluid, and the power cord 38 is plugged into a household electrical outlet. Upon pressing the actuator 48, the valve 50 is opened and fluid flows from the supply tank 40 to the steam generator 30. In the steam generator 30, fluid is heated to its boiling point to produce steam by flashing off the heating element 78. The generated steam is pushed out from the steam generator 30 and guided downwardly through the steam outlet 54 in the foot 14 towards the surface to be cleaned. Meanwhile, the transducer 62 provides ultrasonic waves to the cleaning pad 58 via the horn 64, and energy is transferred to water molecules in the pad 58 to generate reactive oxygen species. The sonolysis reaction is frequency dependent, and a frequency in the range of 20-500 kHz can be supplied to the pad 58 in the presence of water molecules in order for the sonolysis reaction to take place. More particularly, a frequency of around 20 kHz can be supplied to the pad 58 in the presence of water molecules in order for the sonolysis reaction to take place. Frequencies below 20 kHz are not effective because the cavitation produced at these lower frequencies is too weak for a substantial amount of reactive oxygen species to be produced. Higher frequencies, including those up to 500 kHz can also be used to produce reactive oxygen species; frequencies higher than 500 kHz may not be practical since too much energy is required.

At the steam outlet 54, the generated reactive oxygen species can comingle with the generated steam, and reactive oxygen species-infused steam can pass through the cleaning pad 58. As steam passes through the cleaning pad 58, a portion of the steam may return to liquid form before reaching the floor surface. The steam delivered to the floor surface also returns to liquid form. As the damp cleaning pad 58 is wiped over the surface to be cleaned, excess liquid and dirt on the surface is absorbed by the cleaning pad 58.

While only one transducer 62 is shown in the foot 14, it is within the scope of the invention for multiple transducers 62 to be provided in the foot 14, each with a horn 64 that contacts the cleaning pad 58 at a different location. By distributing ultrasonic waves at multiple locations, the amount of generated reactive oxygen species can be increased.

Figure 4:
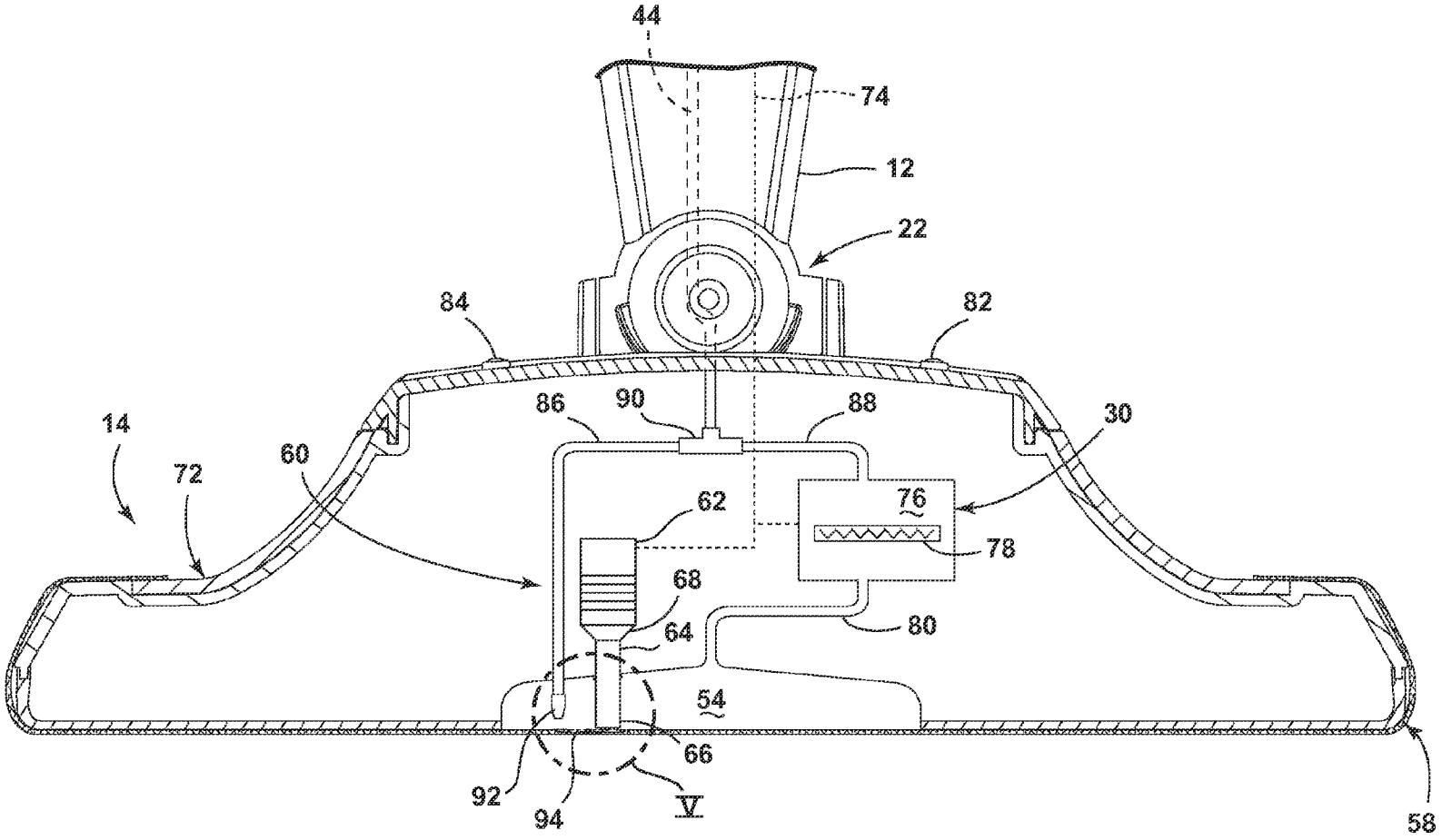
FIG. 4 is a schematic view of a foot in accordance with a third embodiment of the invention.

FIG. 4 is a schematic view of a foot 14 that can be used with the steam mop 10 of FIG. 2 in accordance with a third embodiment of the invention. The third embodiment is similar to the second embodiment, except that the fluid distribution system 26 stores and delivering fluid to both the steam generator 30 and the reactive oxygen species generator 60. Within the foot 14, the fluid conduit 44 branches into a first conduit 86 supplying fluid to the reactive oxygen species generator 60 and a second conduit 88 supplying fluid to the steam generator 30 at a tee 90.

The first conduit 86 to the reactive oxygen species generator 60 couples with an outlet nozzle 92 provided on the housing 72. The second conduit 88 to the steam generator 30 couples with the cavity 76 above the heating element 78, such that fluid falls on the heating element 78. The second conduit 88 can include an orifice restrictor (not shown) for limiting the flow rate of fluid into the cavity 76 of the flash heater to achieve a drip-type dispersion of fluid onto the heating element 78.

Figure 5:
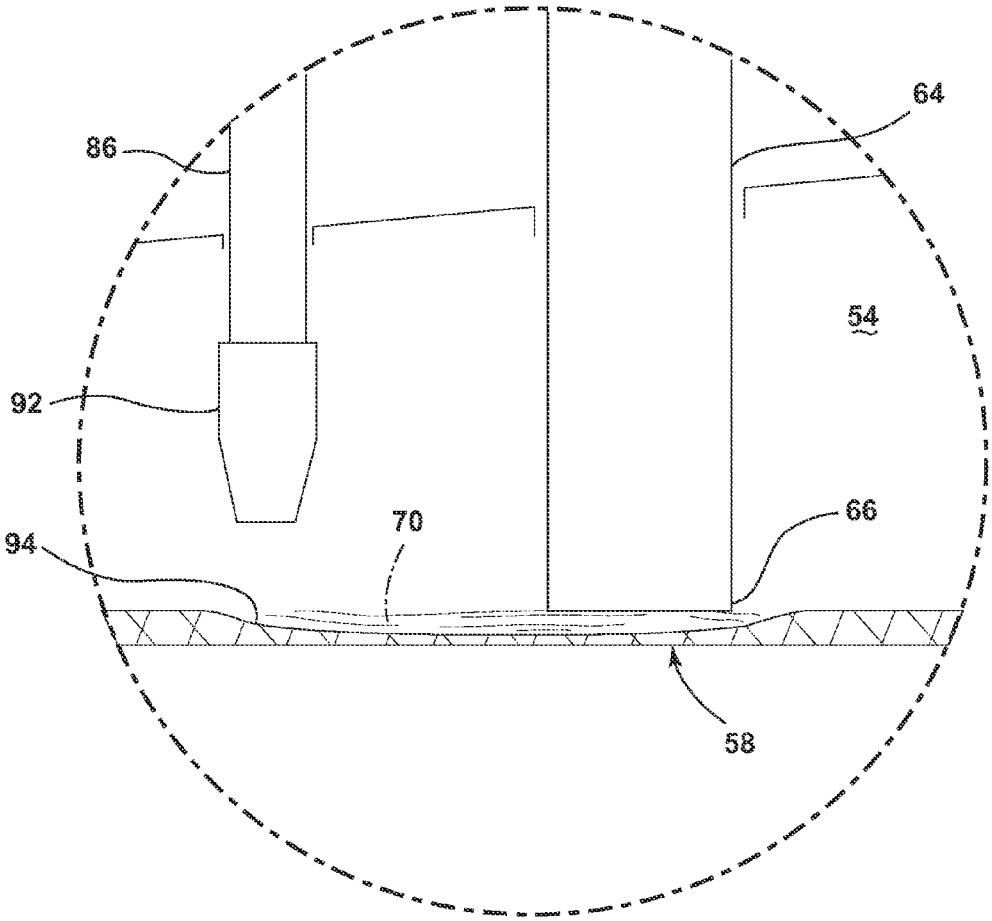
FIG. 5 is a close-up view of section V of FIG. 4.

FIG. 5 is a close-up view of section V of FIG. 4. Another difference between the second and third embodiments is that the cleaning pad 58 is provided with a reservoir 94 for receiving fluid from the nozzle 92. The reservoir 94 can be an open depression in the top of the pad 58 in which fluid collects to form a pool acting as the fluid source 70 for the sonolysis reaction of the reactive oxygen species generator 60.

The nozzle 92 and the horn 64 are positioned above the pad reservoir 94, such that fluid is dispensed to the reservoir 94 by the nozzle 92 forming the pool 70 can be exposed to ultrasonic waves from the output tip 66 of the horn 64. The first conduit 86 can include an orifice restrictor (not shown) for limiting the flow rate of fluid into the reservoir 94 to limited the volume of fluid dispensed to the pad 58. In the illustrated embodiment, the reservoir 94 is supplied with water from the tank 40 (FIG. 2), but may bypass the steam generator 30 such that the water is supplied in fluid form to the reservoir 94. In an alternate configuration, a separate tank (not shown) can provide fluid to the reservoir 94, with the tank 40 only supplying the steam generator 30.

The output tip 66 of the horn 64 is positioned to contact the pool 70, rather than directly contacting the pad 58; therefore, the ultrasonic waves from the horn 64 are focused on the water pool 70. The application of ultrasonic waves to the fluid contained in the reservoir 94 in the cleaning pad 58 increases the reaction rate because the waves are concentrated on the fluid pool 70 confined by the reservoir 94. Simply applying waves directly to the pad 58 can allow the energy from the waves to disperse to the pad material, rather than being directed to the water molecules. By focusing the waves on the fluid pool 70 in the reservoir 94, the energy is concentrated on the water molecules and facilitates the sonolysis reaction through cavitation. At the cleaning pad 58, the generated reactive oxygen species can comingle with the generated steam, and reactive oxygen species-infused steam can be applied to the surface to be cleaned. As discussed above for the first embodiment, the horn 64 can supply ultrasonic waves in the range of 20-500 kHz, and more particularly, around 20 kHz.

While only one transducer 62 and reservoir 94 are shown in the third embodiment, it is within the scope of the invention for multiple sets of transducers 62 and reservoirs 94 to be provided, each with a horn 64 that contacts the pool 70 defined by the reservoirs at a different location on the cleaning pad 58. By distributing water molecules and ultrasonic waves at multiple locations, the amount of generated reactive oxygen species can be increased.

Figure 6:
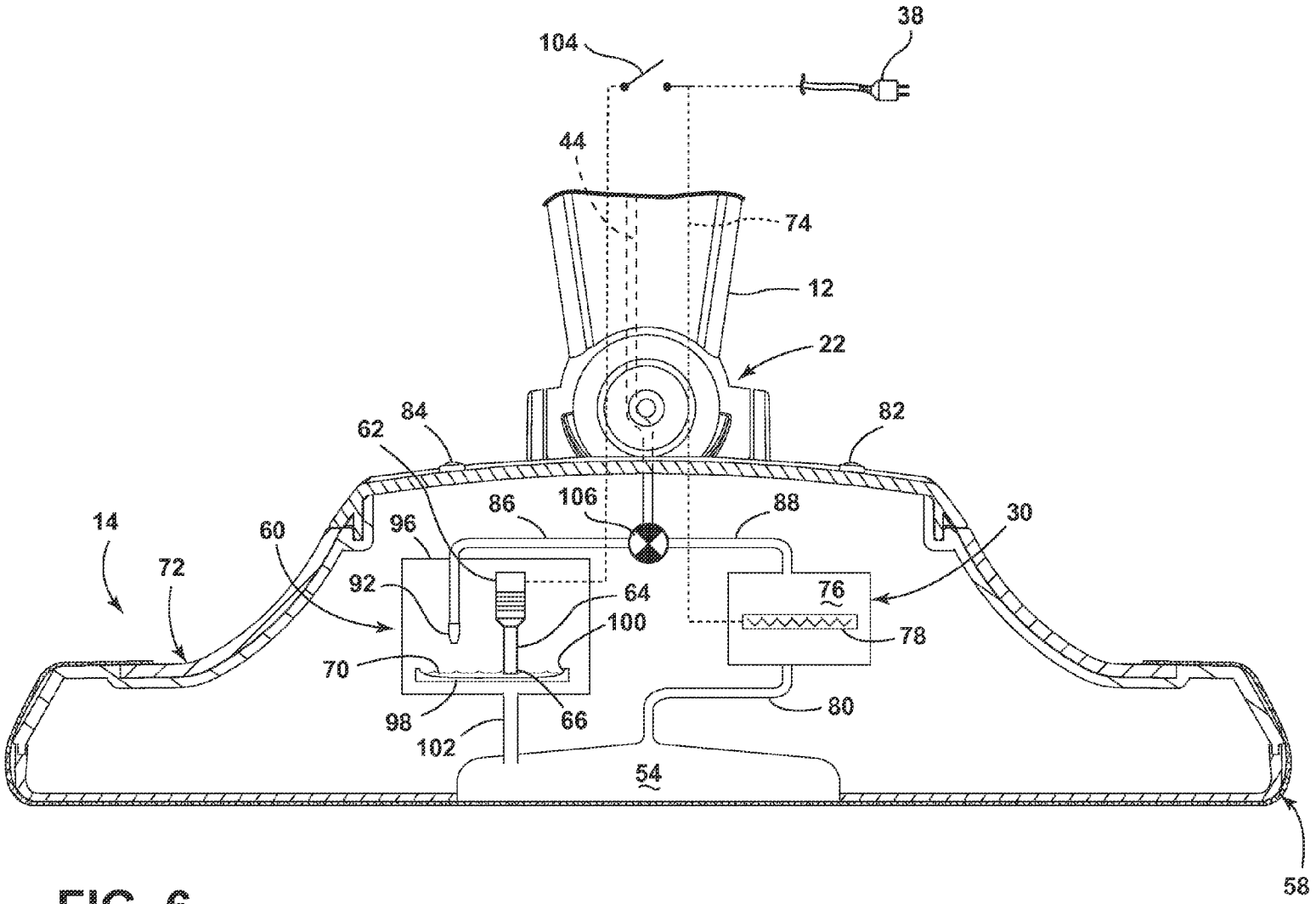
FIG. 6 is a schematic view of a foot in accordance with a fourth embodiment of the invention.

FIG. 6 is a schematic view of a foot 14 that can be used with the steam mop 10 of FIG. 2 in accordance with a fourth embodiment of the invention. This embodiment differs from the second embodiment by the provision of a cavity 96 defined within the housing 72 in which a plate 98 defining a reservoir 100 is located. The reservoir 100 can be an open depression in the top of the plate 98 in which fluid collects to form a pool acting as the fluid source 70 for the sonolysis reaction of the reactive oxygen species generator 60. The transducer 62 can also be at least partially located within the cavity 96 such that the output tip 66 can contact the fluid source 70.

The first conduit 86 to the reactive oxygen species generator 60 couples with the cavity 96 above the plate 98, such that fluid falls into the reservoir 100 and is exposed to ultrasonic waves from the horn 64. An outlet conduit 102 of the reactive oxygen species generator 60 extends from the cavity 96 to the steam outlet 54, such that generated reactive oxygen species are delivered to the cleaning pad 58. The outlet conduit 102 can be relatively short, such that generated reactive oxygen species are delivered to the surface to be cleaned and do not reform into water molecules.

The nozzle 92 and the horn 64 are positioned above the reservoir 100, such that fluid is dispensed to the reservoir 100 by the nozzle 92 forming the pool 70 can be exposed to ultrasonic waves from the output tip 66 of the horn 64. As discussed above for the first embodiment, the horn 64 can supply ultrasonic waves in the range of 20-500 kHz, and more particularly, around 20 kHz, to induce cavitation.

In the illustrated embodiment, the reservoir 100 is supplied with water from the tank 40 (FIG. 2), but may bypass the steam generator 30 such that the water is supplied in liquid form to the reservoir 100. In an alternate configuration, a separate tank (not shown) can provide liquid to the reservoir 100, with the tank 40 only supplying the steam generator 30.

In this embodiment, a separate switch 104 can be provided to selectively turn on the transducer 62, such that a user can control the operation of the reactive oxygen species generator 60 independently of the operation of the steam generator 30. Also, a valve 106 can be provided for selectively directing all fluid to the steam generator 30 or dividing the fluid between the steam generator 30 and the reactive oxygen species generator 60, and can be coupled with the switch 104 such that the valve 106 opens to supply a portion of the fluid to the reactive oxygen species generator 60 when the switch 104 closes to turn on the transducer 62.

The surface cleaning apparatus disclosed herein provides an improved cleaning operation. One advantage that may be realized in the practice of some embodiments of the described surface cleaning apparatus is that reactive oxygen species can be produced in situ from water molecules stored on the steam mop 10. Previous floor cleaning devices have attempted improve cleaning performance by direct vibration of the surface to be cleaned or applying vibrations to a cleaning pad, but do not reactive oxygen species. The surface cleaning apparatus described herein conducts the reaction on board, and the generated reactive oxygen species can treat organic stains and soils via oxidation. The application of steam along with the reactive oxygen species is also beneficial since steam can successfully treat other types of stains which reactive oxygen species may miss. However, while providing the reactive oxygen species generator 60 on a steam mop 10 may offer a more comprehensive cleaning performance since the steam can treat other types of stains that reactive oxygen species does not, for some applications the surface cleaning apparatus need only distribute reactive oxygen species to the surface to be cleaned. For example, the reactive oxygen species generator 60 can be provided on a Swiffer® Wet Jet or other fluid-distributing floor mop. Furthermore, using water molecules in liquid form rather than steam form may result in more generated reactive oxygen species.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A surface cleaning apparatus comprising:

a housing adapted to be moved across a surface to be cleaned;

a fluid distribution system provided with the housing for storing and supplying a fluid, and comprising a supply tank from which a portion of the fluid is provided;

a cleaning pad mounted to the housing and in fluid communication with the fluid distribution system; and a reactive oxygen species generator provided with the housing in fluid communication with the supply tank, the reactive oxygen species generator comprising:

a transducer; and an acoustic horn operably coupling the transducer to the portion of the fluid;

wherein the acoustic horn transfers energy to the portion of the fluid to generate reactive oxygen species which are provided to the cleaning pad.

2. The surface cleaning apparatus of claim 1, wherein the housing comprises a lower housing moveably coupled with an upper housing, and wherein the cleaning pad is attached to the lower housing.

3. The surface cleaning apparatus of claim 1, wherein the surface cleaning apparatus comprises a steam generator provided with the housing and having a steam outlet for delivering steam to the cleaning pad.

4. The surface cleaning apparatus of claim 3, wherein the steam outlet is further fluidly coupled with the reactive oxygen species generator such that the steam co-mingles with the generated reactive oxygen species before being delivered to the cleaning pad.

5. The surface cleaning apparatus of claim 3, wherein the steam generator includes a first cavity defined within the housing and comprises a heating element mounted within the first cavity.

6. The surface cleaning apparatus of claim 5, wherein the reactive oxygen species generator includes a second cavity defined within the housing in which the transducer and the acoustic horn are located.

7. The surface cleaning apparatus of claim 6, wherein the reactive oxygen species generator further comprises a fluid reservoir located within the second cavity for holding the portion of the fluid, wherein the acoustic horn is configured to contact the portion of the fluid held in the fluid reservoir.

8. The surface cleaning apparatus of claim 6, wherein the first and second cavities are in fluid communication with the supply tank, such that the first and second cavities are supplied with fluid from the supply tank.

9. The surface cleaning apparatus of claim 8, and further comprising a valve for selectively controlling the supply of fluid from the supply tank to one of the first and second cavities.

10. The surface cleaning apparatus of claim 8, wherein the first and second cavities are in fluid communication with the at least one steam outlet.

11. The surface cleaning apparatus of claim 1, wherein the housing defines an interior in which the transducer is located and wherein the acoustic horn projects out of the housing to directly contact an upper surface of the cleaning pad to which the portion of the fluid is provided.

12. The surface cleaning apparatus of claim 1, wherein the fluid distribution system further comprises:

a first conduit in fluid communication between the supply tank and the reactive oxygen species generator to supply fluid to the reactive oxygen species generator; and a second conduit in fluid communication between the supply tank and the cleaning pad to supply fluid to the cleaning pad.

13. The surface cleaning apparatus of claim 12, wherein the cleaning pad comprises a reservoir for receiving fluid from the first conduit, wherein the fluid received by the reservoir forms the portion of the fluid.

14. The surface cleaning apparatus of claim 13, wherein the reservoir comprises an open depression in a top surface of the cleaning pad.

15. The surface cleaning apparatus of claim 1, wherein the reactive oxygen species generator comprises an ultrasound generator configured to deliver ultrasound having a frequency in the range of 20-500 kHz.

16. A method of generating reactive oxygen species onboard a surface cleaning apparatus having a housing with a cleaning pad attached to the housing, the method comprising:

ultrasonically cavitating a fluid containing water molecules to generate reactive oxygen species; and providing the generated reactive oxygen species to the cleaning pad.

17. The method of claim 16, and further comprising:

wetting the cleaning pad with a fluid containing water molecules;

wherein ultrasonically cavitating a fluid containing water molecules comprises ultrasonically cavitating the wetted cleaning pad.

18. The method of claim 16, and further comprising:

dispensing a fluid to a reservoir provided in one of the housing or the cleaning pad;

wherein ultrasonically cavitating a fluid containing water molecules comprises ultrasonically cavitating the fluid within the reservoir.

19. The method of claim 18, wherein the reservoir is provided on a top surface of the cleaning pad.

20. The method of claim 16, wherein ultrasonically cavitating a fluid containing water molecules comprises applying ultrasonic cavitation with an on-board acoustic horn to split the water molecules into reactive oxygen species.

* * * * *